US011497337B2

(12) United States Patent
Yu

(10) Patent No.: US 11,497,337 B2
(45) Date of Patent: Nov. 15, 2022

(54) CURTAIN STRUCTURE

(71) Applicant: ARLINEA INDUSTRIES CO., Taoyuan (TW)

(72) Inventor: Yu-Heng Yu, Taoyuan (TW)

(73) Assignee: ARLINEA INDUSTRIES CO., Taoyuan (TW)

( * ) Notice: Subject to any disclaimer, the term of this patent is extended or adjusted under 35 U.S.C. 154(b) by 271 days.

(21) Appl. No.: 16/868,674

(22) Filed: May 7, 2020

(65) Prior Publication Data

US 2021/0345809 A1 Nov. 11, 2021

(51) Int. Cl.

| | |
|---|---|
| ***A47H 5/02*** | (2006.01) |
| ***A47H 1/04*** | (2006.01) |
| ***A47H 5/032*** | (2006.01) |

(52) U.S. Cl.

CPC ..... *A47H 5/02* (2013.01); *A47H 1/04* (2013.01); *A47H 5/0325* (2013.01)

(58) Field of Classification Search

CPC ..... A47H 5/02; A47H 1/04; A47H 2001/042; A47H 5/032; A47H 5/0325; A47H 5/00; A47H 2/00; A47H 2001/006; Y10T 16/353

USPC ..... 160/331, 340, 344, 345, 368.1; 211/105.1; 248/261

See application file for complete search history.

(56) References Cited

U.S. PATENT DOCUMENTS

| | | | | |
|---|---|---|---|---|
| 3,327,194 | A * | 6/1967 | Trapp | A47H 5/0325 160/331 |
| 4,827,199 | A * | 5/1989 | Kaucic | A47H 5/0325 160/331 |
| 6,076,592 | A * | 6/2000 | Grutzner | A47H 5/0325 160/331 |
| 6,085,826 | A * | 7/2000 | Maesaki | A47H 5/0325 160/331 |

(Continued)

FOREIGN PATENT DOCUMENTS

| | | |
|---|---|---|
| CN | 203693219 U | 7/2014 |
| CN | 204015901 U | 12/2014 |

(Continued)

OTHER PUBLICATIONS

Office Action dated Aug. 31, 2020 of the corresponding Taiwan patent application No. 109108773.

(Continued)

*Primary Examiner* — Jennifer E. Novosad

(74) *Attorney, Agent, or Firm* — Chun-Ming Shih; HDLS IPR Services

(57) ABSTRACT

A curtain structure assembled with an accessory (900) includes a curtain rod (1), a frame (2, 3), and a coupling member (4A, 4B, 4C). The frame (2, 3) is detachably installed and movably fixed to an end of the curtain rod (1), and the fixed frame (2, 3) has a protruding structure (T1 or T2) protruding from an end of the curtain rod (1), and the protruding structure (T1 or T2) includes a fixed portion (25 or 35) with a driven wheel (23 or 24), and the coupling member (4A, 4B, 4C) is detachably connected between the (Continued)

protruding structure (T1 or T2) and the connected accessory (900) is disposed between the curtain rod (1) and the accessory (900). The electric fan has the effects of installing or moving the accessory (900) and the coupling member (4A, 4B, 4C), and adjusting the tightness of the belt effectively.

7 Claims, 5 Drawing Sheets

(56) References Cited

U.S. PATENT DOCUMENTS 6,141,827 A * 11/2000 Wu ..... E04F 10/0607 16/106
6,830,092 B1 * 12/2004 Hsu ..... E06B 9/323 160/348
9,038,697 B2 * 5/2015 Ikeda ..... A47H 5/0325 160/331
11,060,346 B2 * 7/2021 Chuang ..... E06B 9/367
2003/0106653 A1 * 6/2003 Braak ..... A47H 1/04 160/331
2003/0121622 A1 * 7/2003 Killo ..... A47H 5/0325 160/331
2004/0026049 A1 * 2/2004 Park ..... A47H 5/0325 160/331
2006/0162877 A1 * 7/2006 Chou ..... A47H 5/0325 160/331
2009/0283225 A1 * 11/2009 Luger ..... E06B 9/40 160/310
2010/0224332 A1 * 9/2010 Hibshman ..... A47H 1/08 160/405
2011/0247174 A1 * 10/2011 Keishold ..... A47H 1/04 16/96 R
2011/0259531 A1 * 10/2011 Hendriks ..... A47H 5/032 160/168.1 P
2012/0261370 A1 * 10/2012 Chuang ..... A47H 1/022 211/123
2015/0020622 A1 * 1/2015 Lin ..... F16H 19/0622 74/89.22
2015/0107788 A1 * 4/2015 Mullet ..... A47H 5/0325 160/405
2015/0354274 A1 * 12/2015 Yu ..... A47H 5/0325 160/310
2020/0146494 A1 * 5/2020 Yang ..... A47H 1/022
2021/0345809 A1 * 11/2021 Yu ..... A47H 5/02
2022/0087466 A1 * 3/2022 Jiang ..... A47H 1/08

FOREIGN PATENT DOCUMENTS

EP 2954808 A1 12/2015
TW M580388 U 7/2019

OTHER PUBLICATIONS

Search Report dated Oct. 21, 2020 of the corresponding European patent application No. 20173547.9.
Office Action dated Apr. 14, 2022 of the corresponding China patent application No. 202010216616.8.

* cited by examiner

CURTAIN STRUCTURE

BACKGROUND OF THE INVENTION

1. Technical Field

The technical field relates to electric curtains, and more particularly to an electric curtain with a convenient installation and removal function and a belt tightness adjusting function concurrently.

2. Description of Related Art

In general, an electric curtain comprises a curtain rod installed onto a wall and configured to be corresponsive to an upper edge of a window, a curtain body (such as a piece of curtain cloth) hung under the curtain rod, and an electric motor for controlling the curtain body to an open or closed position.

However, both ends of the curtain rod are usually assembled with an accessory for aesthetic purposes, and the accessories of the conventional electric curtain generally have the issue of inconvenient installation or removal, which is not conducive to maintenance, repair, or replacement of the accessories.

In the control of the conventional electric curtain to the open or closed position, the electric motor is used to drive a belt to rotate, so that it is necessary to adjust the tightness of the belt during an installation or after a long-time use, but the conventional electric curtain usually does not have the function of adjusting the tightness of the belt, which has been criticized for a long time.

In view of the aforementioned drawbacks of the prior art, the discloser of this disclosure based on years of experience in the related industry to conduct extensive research and experiment, and finally provided a feasible solution to overcome the drawbacks of the prior art.

SUMMARY OF THE INVENTION

Therefore, it is a primary object of this disclosure to provide an electric curtain to facilitate the installation and removal of accessories and coupling members and adjusting the tightness of the belt.

To achieve the aforementioned and other objectives, this disclosure discloses an electric curtain assembled with an accessory, and the electric curtain comprises: a curtain rod; a frame with a protruding structure detachably fixed to the curtain rod and protruding from an end of the curtain rod, and the protruding structure having a fixed portion, and the fixed portion having a driven wheel, and the frame being movably fixed to the curtain rod; and a coupling member, detachably coupled between the protruding structure and the accessory, and the coupled coupling member being disposed between the curtain rod and the accessory.

Compared with the prior art, the electric curtain of this disclosure has the effects of facilitating the installation and removal of the accessory and the coupling member to make the repair, maintenance or replacement of other accessories easier, as well as adjusting the tightness of the belt.

DESCRIPTION OF THE PREFERRED EMBODIMENTS

The technical contents of this disclosure will become apparent with the detailed description of preferred embodiments accompanied with the illustration of related drawings as follows. It is intended that the embodiments and drawings disclosed herein are to be considered illustrative rather than restrictive.

With reference to FIGS. 1 to 3 and FIGS. 4 to 5 for an electric curtain (hereinafter referred to as "electric curtain" in accordance with the first and second embodiment of this disclosure respectively, the electric curtain 100 has at least one end assembled with an accessory 900. In this embodiment, both ends of the electric curtain 100 are assembled with an accessory 900. For simplicity, only one end is used as an example for illustrating this disclosure.

Figure 1:
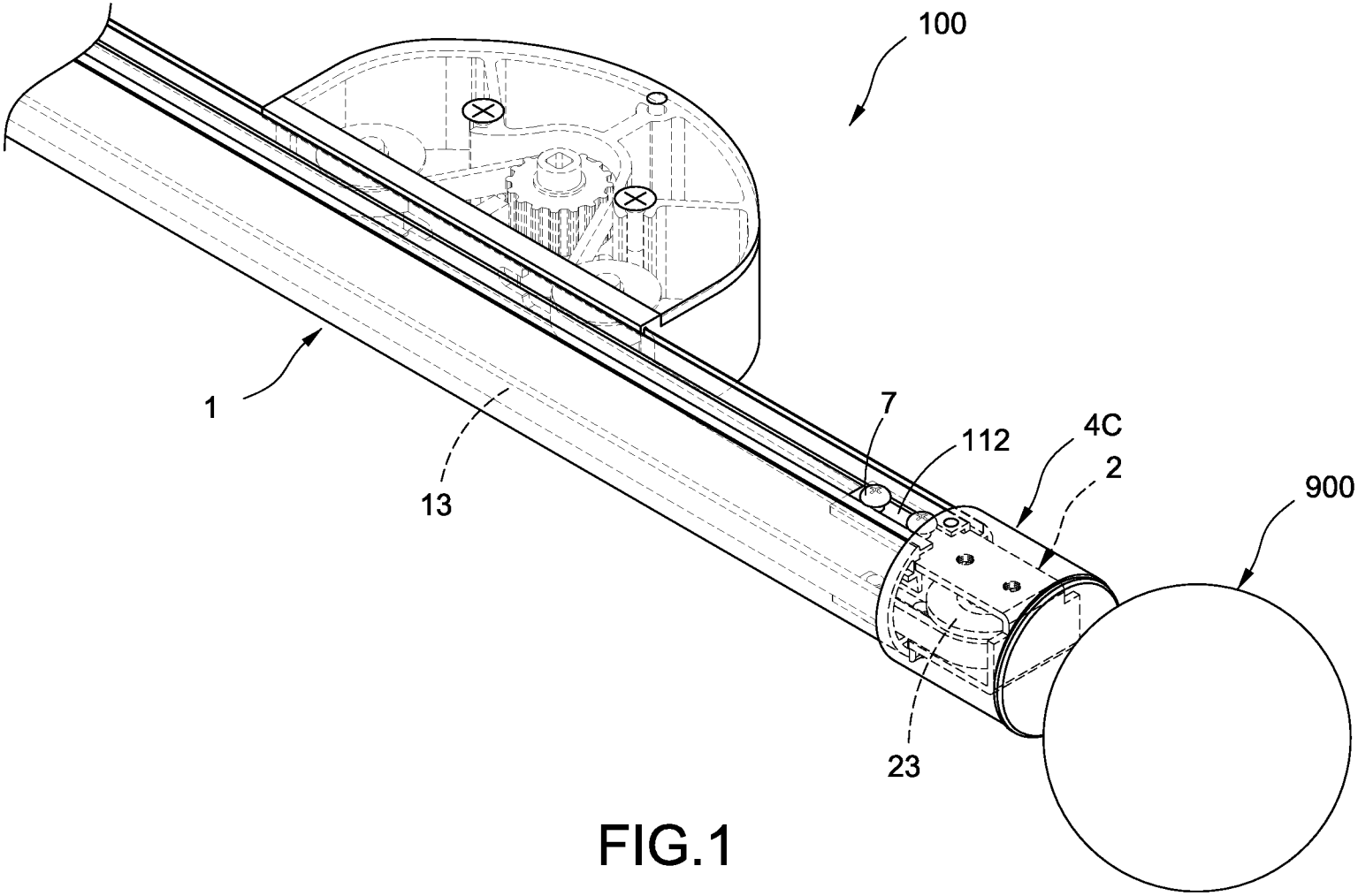
FIG. 1 is a perspective view of an electric curtain in accordance with a first embodiment of this disclosure.
Figure 2:
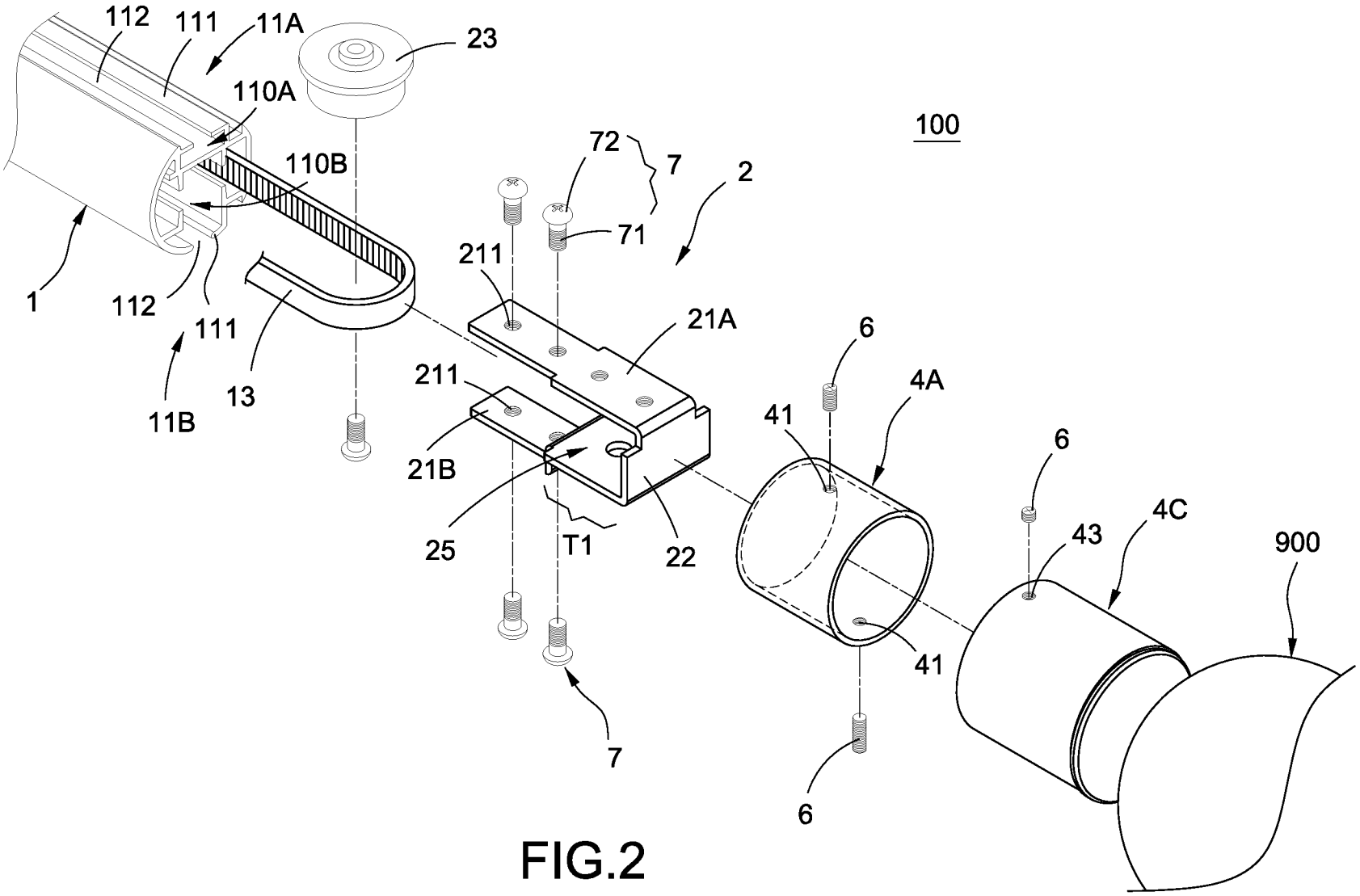
FIG. 2 is an exploded view of an electric curtain in accordance with the first embodiment of this disclosure.
Figure 3:
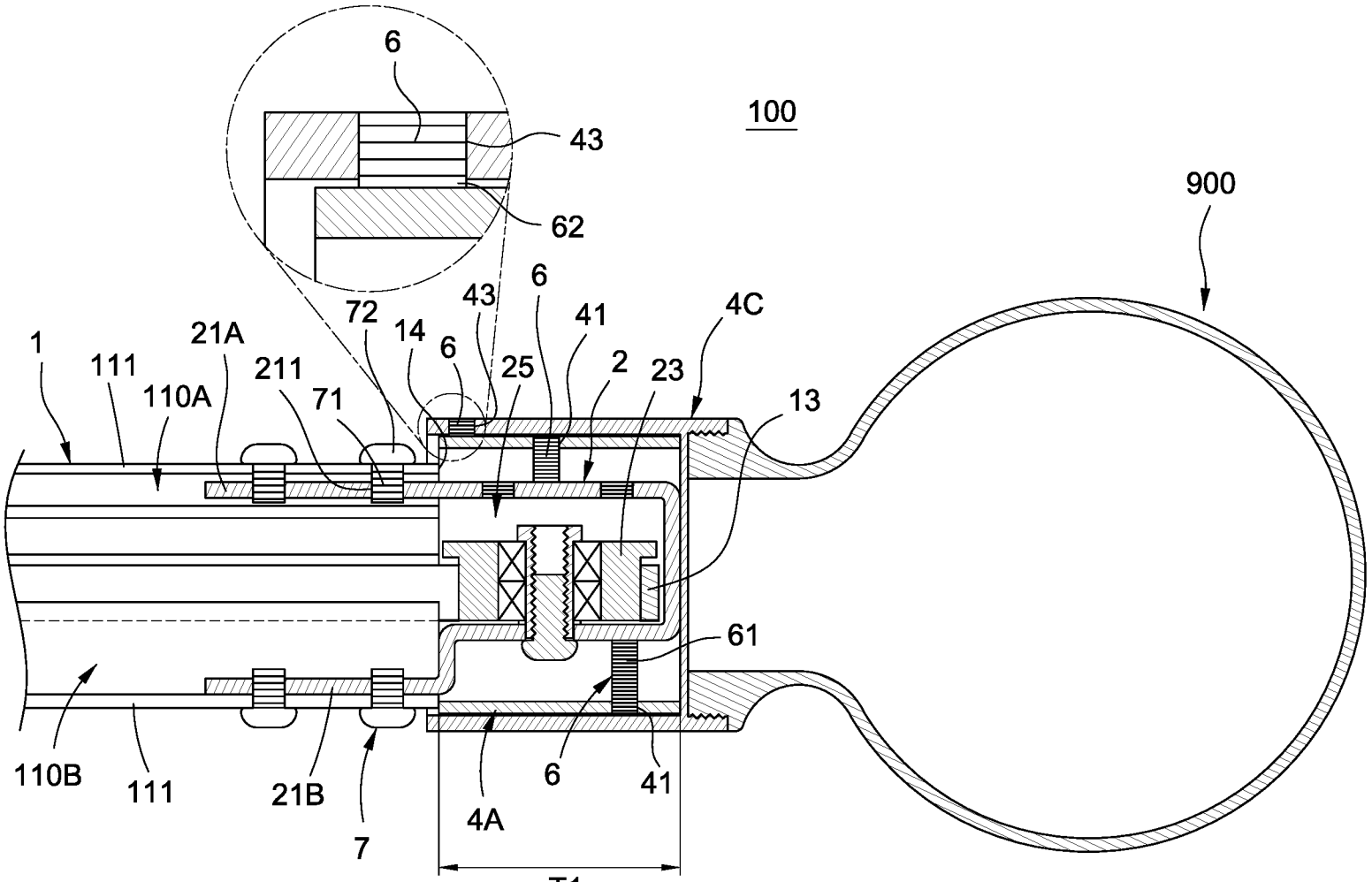
FIG. 3 is a cross-sectional view of an assembly according to FIG. 2.

In FIGS. 1 to 3, the electric curtain 100 of the first embodiment of this disclosure comprises a curtain rod 1, a frame 2 and a coupling member 4A.

The curtain rod 1 has two ends, one having an edge 14. The curtain rod 1 has a belt 13 passing into the interior thereof.

The frame 2 is a metal frame detachably fixed to the interior of the end (which is the end having the edge 14) of the curtain rod 1 and has a protruding structure T1 protruding from the end of the curtain rod 1, and the protruding structure T1 has a fixed portion 25 as shown in FIG. 2. The frame 2 has a driven wheel 23, and the driven wheel 23 of a preferred embodiment is pivotally installed to the fixed portion 25 of the protruding structure T1. The belt 13 is installed around the driven wheel 23.

The coupling member 4A is detachably coupled between the protruding structure T1 and the accessory 900, and the coupled coupling member 4A is disposed between the curtain rod 1 and the accessory 900. In a preferred embodiment, this disclosure further comprises a plurality of first screw members 6, and the coupling member 4A is detachably fixed to the protruding structure T1 and the accessory 900 by the plurality of first screw members 6. The first screw member 6 includes but not limited to a socket set screw.

Wherein, the coupling member 4A is surrounded around the protruding structure T1 and has a first penetrating screw hole 41 formed thereon, and a part of the first screw members 6 is screwed into the first penetrating screw hole 41, and a first projection 61 protruding from the first penetrating screw hole 41 is formed as shown in FIG. 3, and the first projection 61 is provided for abutting against the outer surface of the protruding structure T1, so that the coupling member 4A can be detachably fixed to the protruding structure T1.

This disclosure further comprises another coupling member 4C (or a second coupling member 4C). The coupling member 4A (or the first coupling member 4A) is detachably coupled to the protruding structure T1, and the other coupling member 4C is fixed to or integrally formed with the accessory 900. The other coupling member 4C is surrounded around the coupling member 4A and has a second penetrating screw hole 43, and the other part of the plurality of first screw members 6 is screwed into the corresponding second penetrating screw hole 43, and a second projection 62 slightly protruding out from the second penetrating screw hole 43 is formed after screw connection as shown in FIG. 3, and the second projection 62 abuts against the outer peripheral wall of the coupling member 4A, so that the other coupling member 4C together with the accessory 900 are detachably fixed to the coupling member 4A.

In other embodiments not shown in the figures, this disclosure further comprises a single coupling member 4A (or 4C) having an end fixed to or integrally formed with an accessory 900 (not shown in the figure) and the other end detachably coupled to the protruding structure T1.

When it is necessary to maintain, repair or replace other accessories, or even adjust the tightness of the belt 13 (as described in details below), users only need to remove the first screw member 6 in order to remove the accessory 900 and the coupling member 4A and/or the coupling member 4C easily. On the other hand, the accessory 900 and the coupling member 4A and/or the coupling member 4C can be installed easily. Therefore, this disclosure provides convenient installation and removal.

In FIGS. 1 to 3, the frame 2 of this disclosure is movably fixed to an end of the curtain rod 1, so that the frame 2 can be moved linearly back and forth with respect to the curtain rod 1 in order to adjust the tightness of the belt 13.

In a preferred embodiment, the curtain rod 1 has a rail 11A, and the frame 2 is slidably coupled to the rail 11A and has a fixing screw hole 211. The rail 11A has two side panels 111 parallel to each other and separated from each other, and a spacing 112 formed between the two side panels 111. This disclosure further comprises at least one second screw member 7, and this embodiment has two second screw members 7, and each second screw member 7 has a screw rod 71 and a screw top 72 coupled to an end of the screw rod 71, and the screw rod 71 is passed through the spacing 112 and screwed into the fixing screw hole 211, so that the second screw member 7 can be secured to clamp and fix the two side panels 111 between the screw top 72 and the frame 2 tightly as shown in FIG. 3.

When it is necessary to adjust the tightness of the belt 13, the second screw member 7 is loosened, so that the frame 2 can be controlled to move linearly with respect to the curtain rod 1 to adjust the tightness of the belt 13. When the belt 13 is adjusted to a desired tightness, the second screw member 7 is secured again.

Of course, there can be two rails of the curtain rod 1, and they are the rail 11A and the other rail 11B arranged opposite to each other. The other rail 11B also has two side panels 111 arranged parallel to each other and separated from each other and a spacing 112 defined between the two side panels 111. The rail 11A forms a sliding slot 110A by two side panels 111 and other structures, and the rail 11B also forms a sliding slot 110B by two side panels 111 and other structures. The frame 2 has two slidable connecting plates 21A, 21B configured to be corresponsive to the two rails 11A, 11B respectively and a connecting plate 22 coupled between the ends of the two slidable connecting plates 21A, 21B, and the two slidable connecting plates 21A, 21B slidably coupled to the two sliding slots 110A, 110B respectively and have the fixing screw hole 211 separately.

In FIG. 3, the length of the coupling member 4C after connection must be long enough to protrude out from the edge 14 of the curtain rod 1 in order to cover the edge 14, so that the gap between the curtain rod 1 and the frame 2 and/or the gap between the curtain rod 1 and the coupling member 4A can be hidden.

Figure 4:
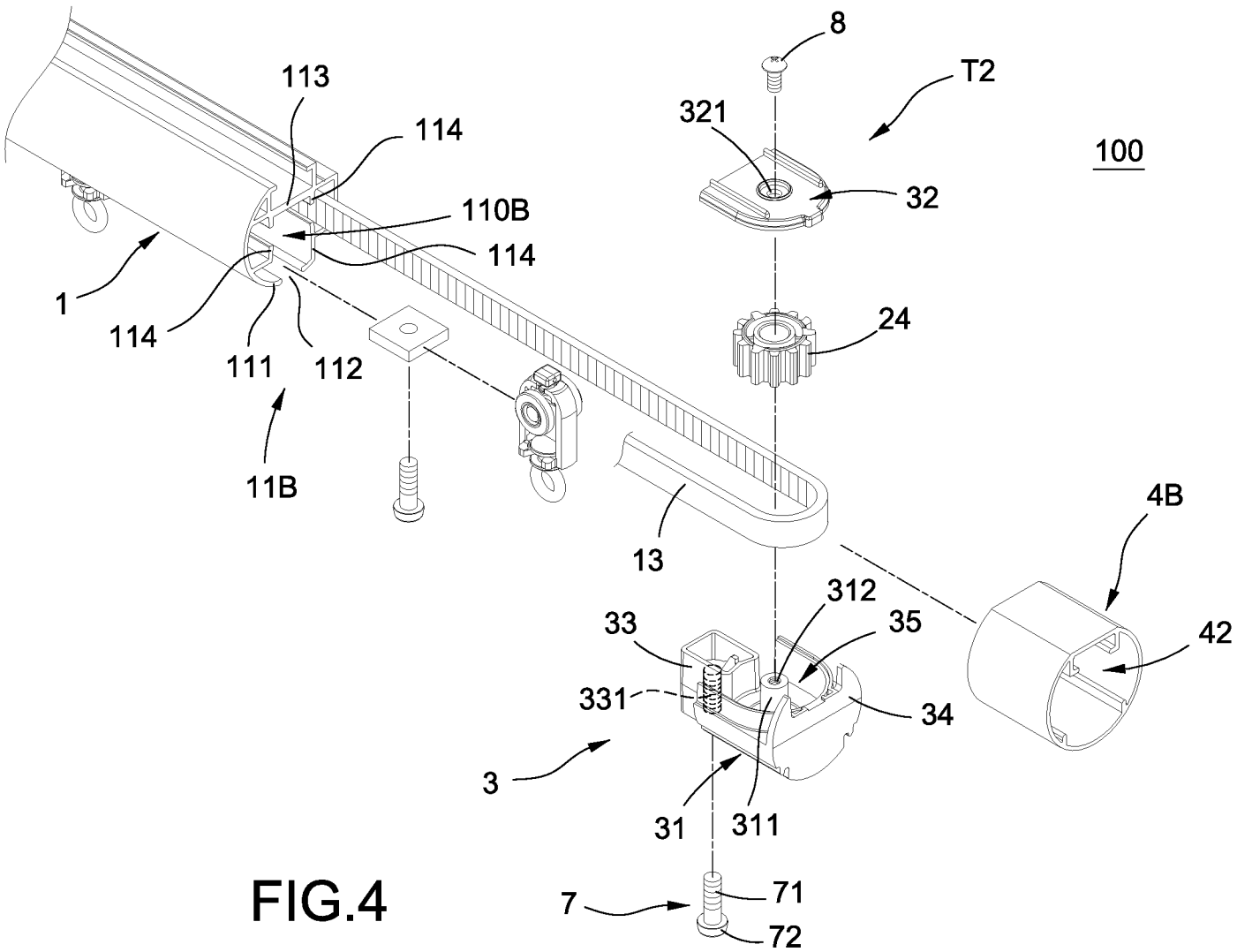
FIG. 4 is an exploded view of an electric curtain in accordance with a second embodiment of this disclosure.
Figure 5:
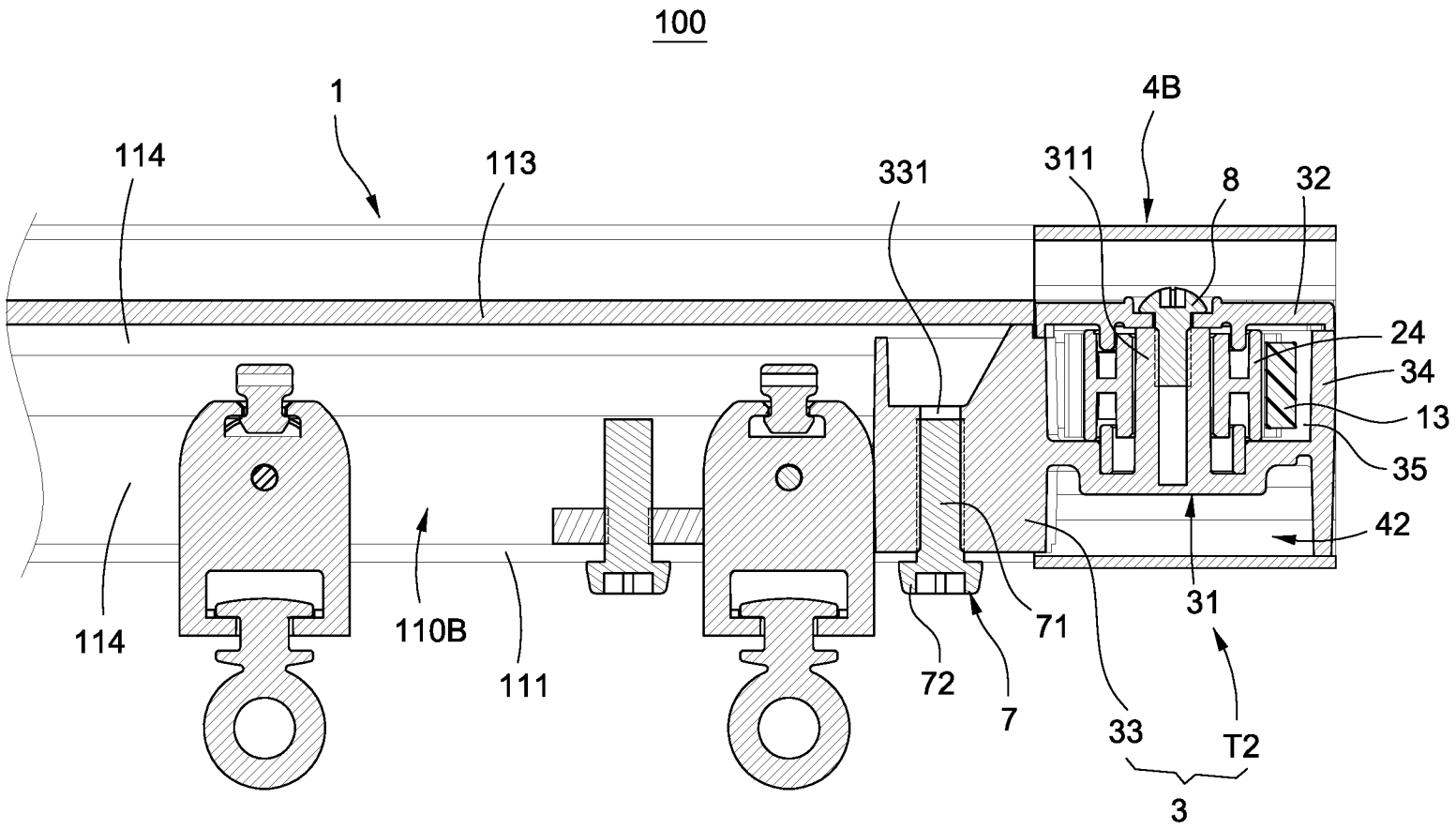
FIG. 5 is a cross-sectional view of an assembly according to FIG. 4.

In FIGS. 4 and 5, the electric curtain 100 in accordance with the second embodiment of this disclosure is substantially the same as that of the first embodiment, and the differences between the second embodiment and the first embodiment are described below.

The frame 3 is a frame formed by plastic injection molding. The frame 3 comprises a protruding structure T2 and a slidable connecting block 33 coupled to the protruding structure T2. In a preferred embodiment, the protruding structure T2 comprises a protruding body 31 and a cover 32 covering the protruding body 31, and the protruding structure T2 has a fixed portion 35 formed between the protruding body 31 and the cover 32 as shown in FIG. 4. Wherein, the protruding body 31 has a column 311 disposed vertically inside the fixed portion 35, and the column 311 has an insert hole 312 formed along the lengthwise direction thereof, and the cover 32 is configured to be corresponsive to the fixed portion 35 and covered onto the protruding body 31, so as to sheath on and cover a driven wheel 24 of the column 311 and limit the driven wheel 24 in the fixed portion 35 between the cover 32 and the protruding body 31 for protection. The belt 13 is wound around the driven wheel 24. The cover 32 has a through hole 321 formed at a position corresponding to the insert hole 312.

The second embodiment of this disclosure further comprises a fastener 8, and the fastener 8 can be passed through the through hole 321 and inserted into the insert hole 312 to fix the cover 32 onto the protruding body 31.

The sliding slot 110B of the curtain rod 1 has a volume greater than that of the the sliding slot 110A, and the volume of the slidable connecting block 33 and the volume of the slidable connecting plate 21A are corresponsive to those of the sliding slot 110B and the sliding slot 110A respectively, so that the frame 3 can be slidably coupled to the sliding slot 110B by the slidable connecting block 33. The slidable connecting block 33 has a fixing screw hole 331 formed at a position corresponding to the spacing 112 of the rail 11B, and the screw rod 71 of the second screw member 7 is passed through the spacing 112 and screwed into the fixing screw hole 331. When the second screw member 7 is secured, the two side panels 111 of the rail 11B are clamped tightly and fixed between the screw top 72 and the slidable connecting block 33 as shown in FIG. 5. In FIG. 4, the sliding slot 110B is defined and enclosed by a top plate 113 of the curtain rod 1, the plurality of side plates 114, and the two side panels 111.

When it is necessary to adjust the tightness of the belt 13, the second screw member 7 is loosened, and the frame 3 is controlled to move linearly with respect to the curtain rod 1 in order to adjust the tightness of the belt 13. After the belt 13 is adjusted to an appropriate tightness, the second screw member 7 is secured again.

In addition, the coupling member 4B of the second embodiment is a hollow cylinder with an interior space 42. The outer end of the protruding body 31 has a corresponding panel 34 in a shape corresponding to that of the interior space 42. The coupling member 4B is surrounded around the protruding structure T2 and the corresponding panel 34 is plugged into the interior space 42, so that the coupling member 4B can be fixed to the protruding structure T2.

Compared with the prior art, this disclosure has the following advantages: This disclosure provides convenient installation and removal of the accessory 900 and the coupling member 4A, 4B and facilitates the maintenance, repair and replacement of other accessories, and even allows users to adjust the tightness of the belt 13 easily.

While this disclosure has been described by means of specific embodiments, numerous modifications and variations could be made thereto by those skilled in the art without departing from the scope and spirit of this disclosure set forth in the claims.

What is claimed is:

1. A curtain structure (100), assembled with an accessory (900) and comprising:

a curtain rod (1);

a frame (2 or 3), detachably fixed to the curtain rod and having a protruding structure (T1 or T2) protruding from an end of the curtain rod, and the protruding structure having a fixed portion (25 or 35), and the fixed portion having a driven wheel (23 or 24), and the frame being movably fixed to the curtain rod;

a coupling member (4A or 4B or 4C), detachably coupled between the protruding structure and the accessory, and the coupled coupling member being disposed between the curtain rod and the accessory; and a plurality of first screw members (6) and a second screw member (7), and the coupling member (4A or 4C) being detachably coupled by the plurality of first screw members, and the curtain rod having a rail (11A), and the frame (2) being slidably coupled to the rail and having a fixing screw hole (211) formed thereon, and the rail having two side panels (111), and a spacing (112) being defined between the two side panels, and the second screw member having a screw rod (71) and a screw top (72), and the screw rod passing through the spacing and being spirally coupled to the fixing screw hole, and the two side panels being included between the screw top and the frame (2).

2. The curtain structure as claimed in claim 1, wherein the frame (2) comprises a slidable connecting plate (21A), and the fixing screw hole has the slidable connecting plate installed thereon, and the rail has a sliding slot (110A) formed thereon, and the slidable connecting plate is slidably coupled to the sliding slot.

3. The curtain structure as claimed in claim 1, wherein the coupling member (4A) is installed around the protruding structure (T1) and has a first penetrating screw hole (41) formed on the coupling member (4A), and a part of the first screw members are coupled to the first corresponding penetrating screw holes respectively by a screw connection and have a first projection (61) protruding from the first penetrating screw hole, and the first projection is abutted against and coupled to the protruding structure.

4. The curtain structure as claimed in claim 3, wherein the coupling member further comprises a first coupling member (4A) and a second coupling member (4C), and the first coupling member is detachably coupled to the protruding structure, and the second coupling member is fixed to the accessory, and the second coupling member is installed around the first coupling member (4A) and has a second penetrating screw hole (43) formed on the second coupling member (4C), and the other part of the first screw members are coupled to the second corresponding penetrating screw holes respectively by a screw connection and have a second projection (62) protruding from the second penetrating screw hole, and the second projection (62) is abutted against and coupled to the first coupling member (4A).

5. The curtain structure as claimed in claim 1, wherein the coupling member (4C) is fixed to the accessory, and the coupling member (4C) is detachably coupled to the protruding structure.

6. The curtain structure as claimed in claim 5, wherein the coupling member (4C) has a second penetrating screw hole (43) formed thereon, and the first screw member is coupled to the second penetrating screw hole by a screw connection and has a second projection (62) protruding out from the second penetrating screw hole, and the second projection (62) is abutted against and coupled to the protruding structure.

7. The curtain structure as claimed in claim 1, wherein the end of the curtain rod is formed into an edge (14), and the coupled coupling member (4A or 4C) is located outside the edge and covers the edge.

* * * * *